US011598116B1

(12) United States Patent
Palmegiani et al.

(10) Patent No.: US 11,598,116 B1
(45) Date of Patent: Mar. 7, 2023

(54) MOUNTING SYSTEM FOR SEPARATING AND CONNECTING FENCING SLABS

(71) Applicant: FLORIDA ALUMINUM SYSTEMS, LLC, Hialeah, FL (US)

(72) Inventors: Jean Marco Palmegiani, Hialeah, FL (US); Carlos Lopez, Hialeah, FL (US)

( * ) Notice: Subject to any disclaimer, the term of this patent is extended or adjusted under 35 U.S.C. 154(b) by 405 days.

(21) Appl. No.: 17/061,191

(22) Filed: Oct. 1, 2020

(51) Int. Cl.
*E04H 17/14* (2006.01)
*E04H 17/00* (2006.01)

(52) U.S. Cl.
CPC ..... *E04H 17/1413* (2013.01); *E04H 17/006* (2021.01); *E04H 17/1456* (2021.01)

(58) Field of Classification Search
CPC . E04H 17/006; E04H 17/009; E04H 17/1413; E04H 17/1447; E04H 17/1452; E04H 17/1456; E04H 17/1486; E04H 17/1488; E04H 17/20; E04H 17/21; E04H 17/22
See application file for complete search history.

(56) References Cited

U.S. PATENT DOCUMENTS 5,702,090 A * 12/1997 Edgman ..... E04H 17/1447 256/65.02
6,755,394 B2 6/2004 Forbis
10,400,042 B2 9/2019 Van Schravendijk
2003/0213947 A1* 11/2003 Takagi ..... E04H 17/168 256/65.02
2019/0284833 A1* 9/2019 Yeh ..... E04H 17/1417
2021/0381271 A1* 12/2021 Schneider ..... E04H 17/1488

FOREIGN PATENT DOCUMENTS

DE 202019106901 U1 * 3/2020
EP 2116676 A1 * 11/2009 ..... E04F 11/1812
FR 2309695 A1 * 11/1976
FR 2651523 A1 * 3/1991
FR 3041016 B3 * 9/2017
GB 2259924 A * 3/1993 ..... E04H 12/2215
KR 20090085188 A * 8/2009
KR 20110101634 A * 9/2011
KR 20110112101 A * 10/2011
KR 20120120883 A * 11/2012

* cited by examiner

*Primary Examiner* — Jonathan P Masinick
(74) *Attorney, Agent, or Firm* — Sanchelima & Associates, P.A.; Christian Sanchelima; Jesus Sanchelima

(57) ABSTRACT

A mounting system for separating and connecting fencing slabs which includes an end beam assembly having opposite sidewalls each having an elongated slot portion recessed within the beams. Additionally, at least one gate partition with distal ends is inserted within the recessed portion of the end beam. The distal end of the partitions includes a cap which conforms to the shape of the slot portion thereby allowing for the partition to be slidably inserted therein. Once inserted, a spacer member is then inserted within the slot portion to create spacing between the partitions inserted to the end beams when forming the fencing structure. A slidable cover is also included to entirely cover a side of the end beam when not in use. The system is utilized to form a desired fencing structure.

20 Claims, 7 Drawing Sheets

MOUNTING SYSTEM FOR SEPARATING AND CONNECTING FENCING SLABS

BACKGROUND OF THE INVENTION

1. Field of the Invention

The present invention relates to a system for connecting fence slabs and, more particularly, to a mounting system for separating and connecting fencing slabs that includes an end beam assembly and a gate partition assembly to assemble a gate formation without the use of soldering.

2. Description of the Related Art

Several designs for a system for connecting fence slabs have been designed in the past. None of them, however, include a mounting system for separating and connecting fencing slabs which include an end beam assembly having opposite sidewalls each having an elongated slot portion recessed within the beams. Additionally, at least one gate partition with distal ends is inserted within the recessed portion of the end beam. The distal end of the partitions includes a cap which conforms to the shape of the slot portion thereby allowing for the partition to be slidably inserted therein. Once inserted, a spacer member is then inserted within the slot portion to create spacing between the partitions inserted to the end beams when forming the fencing structure. A slidable cover is also included to entirely cover a side of the end beam when not in use. The system is utilized to form a fencing structure in a desired area. The end beams and the gate partition configuration will allow the fence structure to be easily assembled and eliminates the need for soldering when constructing the fences. As a result, building the fencing structure becomes more accessible to a user and allows the fencing to be easily customized to fit a user's desired configuration.

Applicant believes that a related reference corresponds to U.S. Pat. No. 6,755,394 issued for a modular fence system. The system includes fence planks designed for insertion into open channels of upper and lower fence rails. The fence rails are supported in a horizontal orientation between intermittent fence posts. Applicant believes that another related reference corresponds to U.S. Pat. No. 10,400,042 issued for a barrier wall has a first vertical support and a second vertical support. The reference further discloses a first wall panel is disposed between the first vertical support and second vertical support. However, the cited references differ from the present invention because they fail to disclose the combination of the end beam assemblies and the gate partition assemblies along with the spacer assemblies. The gate partitions include end caps which are received by slot portions of the end beams. The partitions are then locked within the end beams and separated through spacers.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a mounting system for separating and connecting fencing slabs which eliminates the need for soldering and welding metal work when assembling a fencing structure in a desired fencing location.

It is another object of this invention to provide a mounting system for separating and connecting fencing slabs which provides an easy assembling method for a user building a fencing structure.

It is still another object of the present invention to provide a mounting system for separating and connecting fencing slabs which provides a mounting system which allows a user with little knowledge of welding to construct a durable fencing structure.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
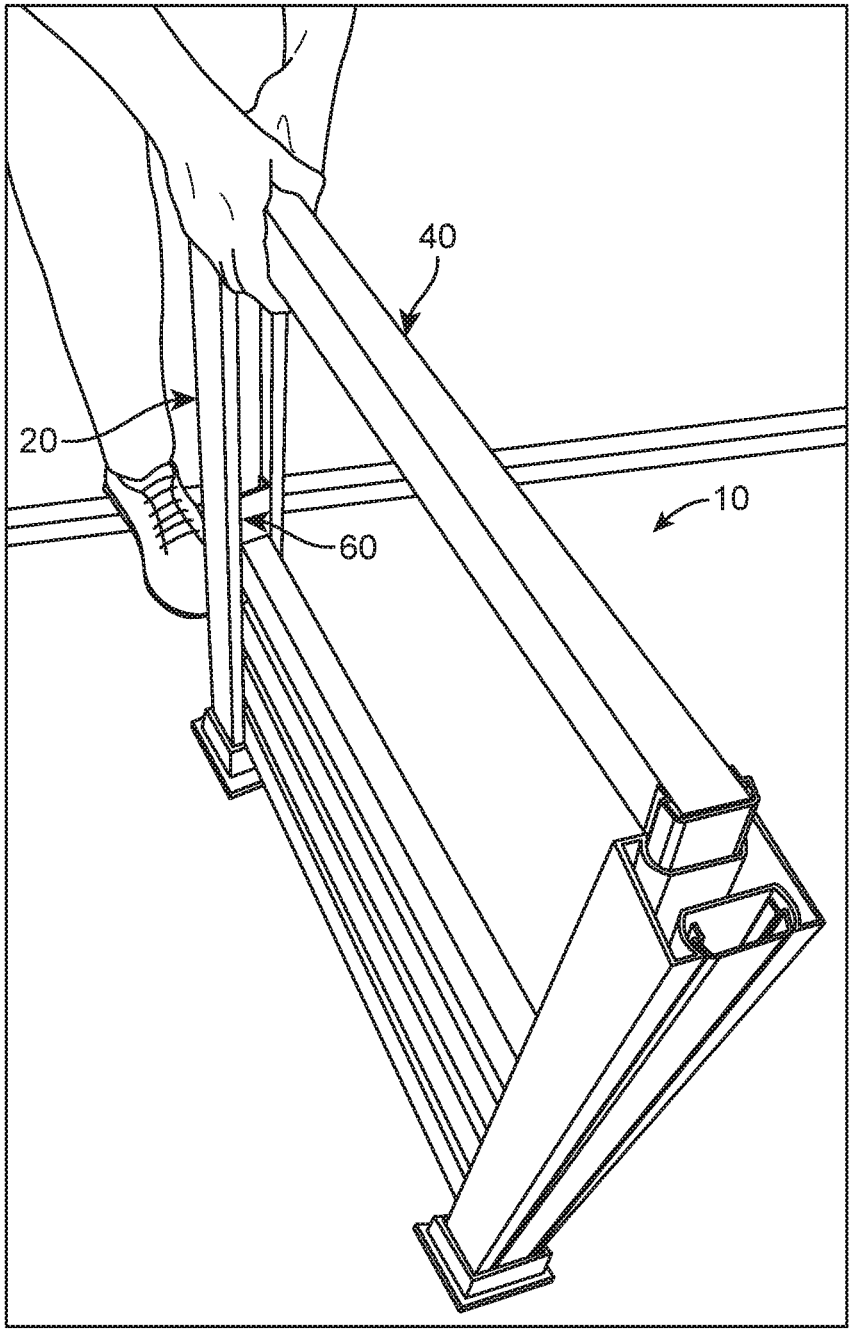
FIG. 1 represents an operational isometric view of mounting system 10 depicting a user assembling a fencing structure in accordance to an embodiment of the present invention.

Referring now to the drawings, where the present invention is generally referred to with numeral 10, it can be observed a fence mounting system 10 which basically includes an end beam assembly 20, a gate partition assembly 40, a spacer assembly 60, and a cover assembly 80.

Figure 2:
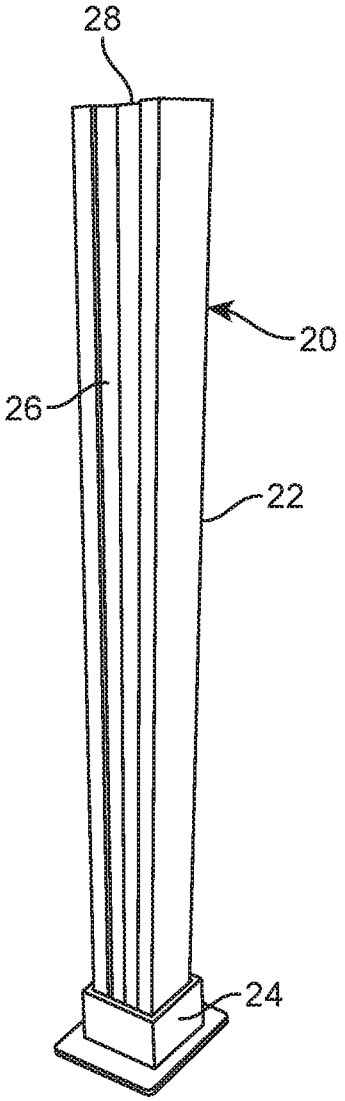
FIG. 2 shows an isometric view of an end beam assembly 20 depicting end beam structure 22, base 24, and slot portion 26 in accordance to an embodiment of the present invention.

End beam assembly 20 includes at least one end beam structure 22 having a base 24. In one embodiment, end beam structure 22 is provided as an upright vertical structure having a defined height. The height provided for end beam structure 22 may correspond to a height of a fencing structure desired to be constructed by a user. Further, end beam structure 22 may be made of an aluminum material configured to withstand substantial weather conditions and changes in environment. In various implementations of the system 10, end beam structure 22 may be provided as a solid structure or a hollow structure allowing a manufacturer to save on materials. Base 24 is provided at a bottom distal end of end beam structure 22 and is configured to be placed on a ground surface. In one embodiment, base 24 is made of the same durable aluminum material used for end beam structure 22. Further, as observed in FIG. 2, base 24 may be provided as a rectangular base which receives end beam structure 22 therein. Additionally, base 24 may be securely mounted to a ground surface using screws, adhesives, and the like. In one embodiment, screws are drilled into four corners of base 24 and into a ground surface to effectively secure end beam structure 22 to a ground surface. Such a configuration will allow end beam structure 22 to maintain structural support and will less susceptible to influence of outside factors such as strong winds and accidental blunt forces.

End beam assembly 20 further includes sidewalls which have an elongated slot portion 26. In the present embodiment, slot portion 26 is located at opposite sidewalls of end beam structure 22. As observed, slot portion 26 extends the entire length of the sidewalls of end beam structure 22 and are recessed into an inner portion of the beam. The present embodiment features two slot portions 26 located at opposite sidewalls. However, one could appreciate that end beam structure 22 may be provided with at least one of slot portion 26. Additionally, end beam structure 22 could be constructed in a configuration such that each sidewall of end beam structure 22 includes a slot portion 26. As a result, slot portions 26 may be placed on either opposite sidewalls or adjacently along end beam structure 22. In the present implementation, slot portion 26 includes a defined inner shape 28 which allows for the efficient mounting of gate partition assembly 40 onto end beam assembly 20. In one embodiment, inner shape 28 is provided as a concave shape extending within said end beam structure 22. A clear representation of inner shape 28 may be observed in FIG. 3 of the provided drawings. In can be observed that inner shape 28 includes a straight edge portion 28A and substantially circular side portions 28B. Straight edge portion 28A defines a back wall of inner shape extending within end beam structure 22. Additionally, circular side portions 28B extends from straight edge portion 28A outwardly from the inner portion of end beam structure 22. This shape provides the optimal configuration for receiving gate partition assembly 40.

Figure 3:
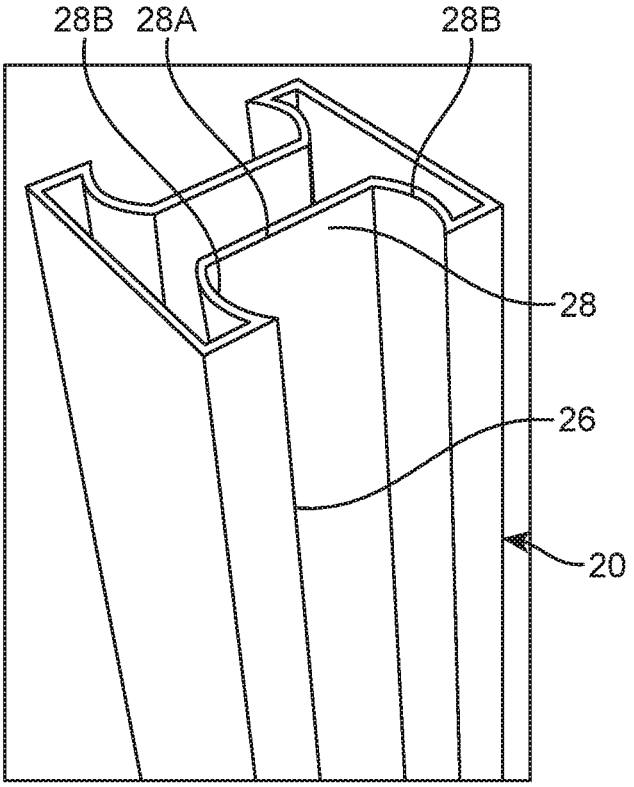
FIG. 3 represents an isometric view of end beam assembly 20 depicting an enlarged view of inner shape 28 in accordance to an embodiment of the present invention.

In one embodiment, as observed in FIG. 3 of the provided drawings, end beam structure 22 includes two slot portions 26 which are separated by a longitudinal channel extending within the end beam structure 22. Additionally, end beam structure 22 also includes two latitudinal parallel channels which are perpendicularly connected to opposing ends of the longitudinal channel. This structure aids in providing stability to the end beam structure while reducing the weight of the end beam structure. This improves the feasibility of the system and allows it to be assembled by a wider range of people.

Figure 4:
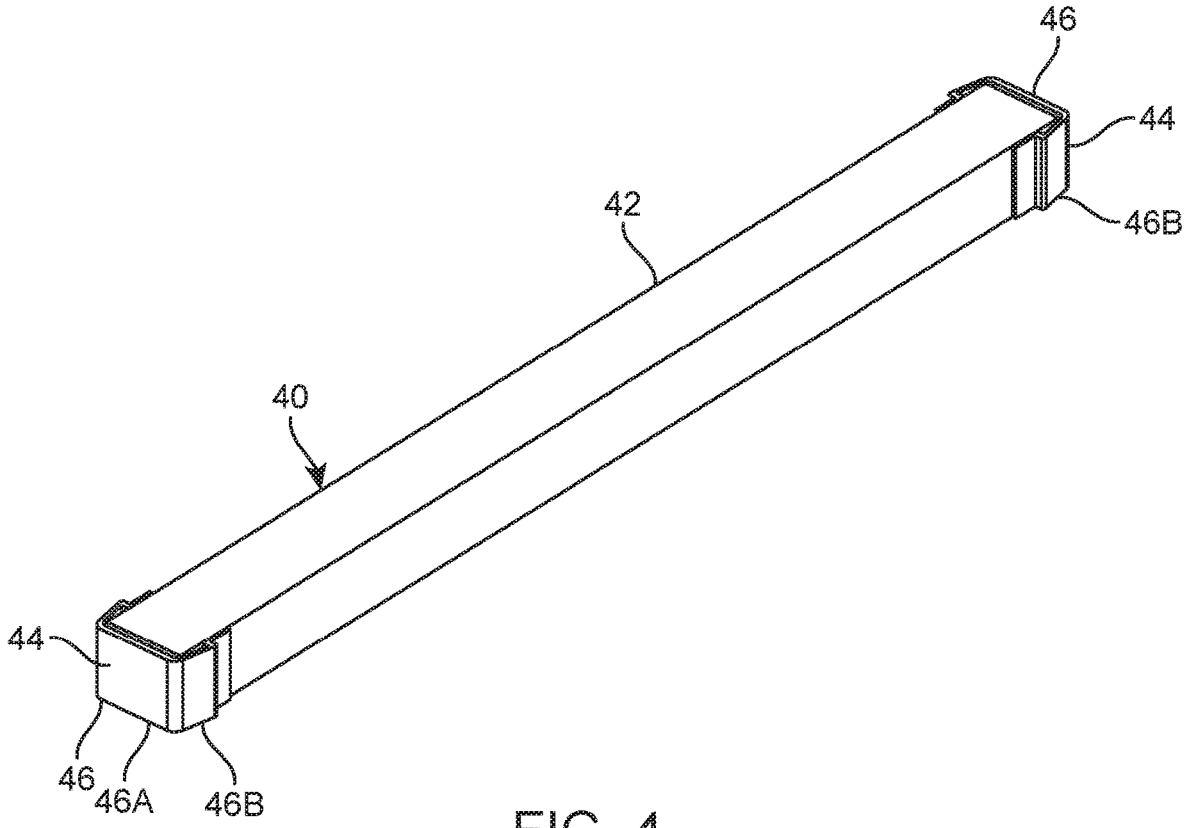
FIG. 4 illustrates an isometric view of a gate partition assembly 40 depicting a gate partition 42 with at least one cap 44 in accordance to an embodiment of the present invention.
Figure 5:
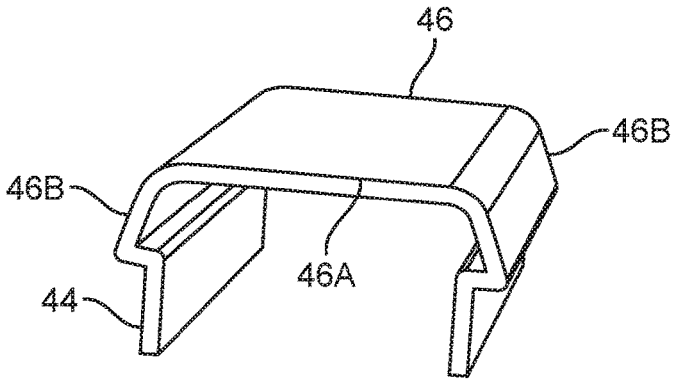
FIG. 5 is a representation of an isometric view of gate partition assembly 40 depicting an enlarged view of a cap 44 in accordance to an embodiment of the present invention.
Figure 6:
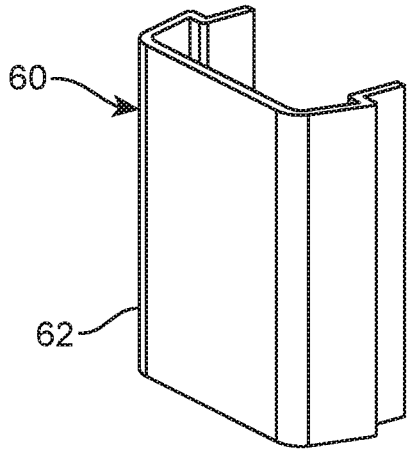
FIG. 6 shows an isometric view of a spacer assembly 60 in accordance to an embodiment of the present invention.
Figure 7:
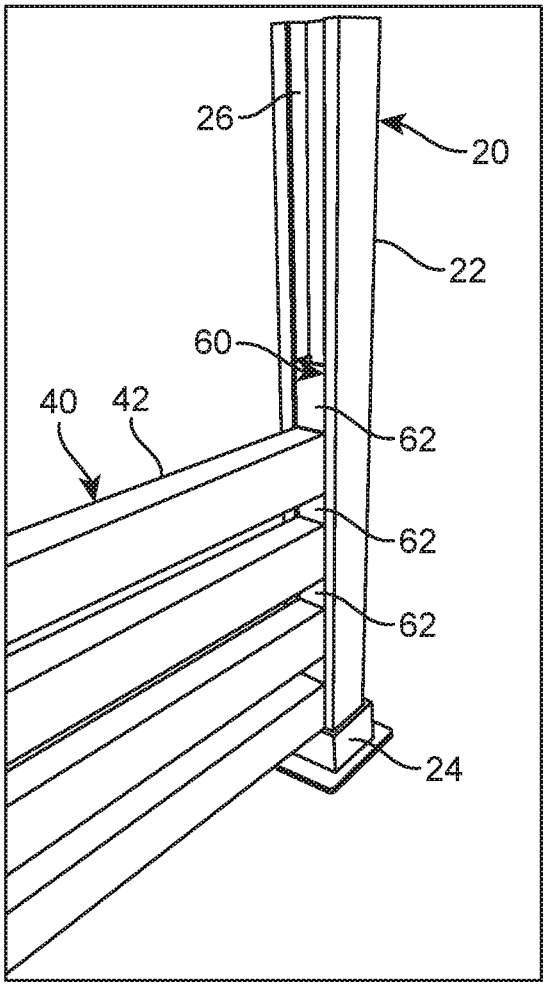
FIG. 7 illustrates an isometric view of spacer assembly 60 inserted mounted to end beam structure 22 positioned between gate partitions 42 in accordance to an embodiment of the present invention.

Gate partition assembly 40 includes at least one gate partition 42 which is to be engaged with end beam assembly 20. In the present embodiment, gate partition 42 is provided as a rectangular structure made of an aluminum material. Additionally, gate partition 42 may be provided as a hollow structure or as a uniform solid structure. As observed in FIG. 4 of the provided drawings, gate partition 42 includes a first distal end and a second distal end which perpendicularly receive end beam structure 22 when mounted thereon. When mounted therein, gate partition 42 extends horizontally from one end beam structure 22 to another end beam structure. Gate partition 42 further includes a cap 44 mounted to each distal end thereof. Cap 44 is a connector cap provided as an aluminum cap which entirely covers and wraps around the distal ends of gate partition 42. In one implementation, cap 44 is mounted to gate partition 42 by means of screws used to mount sides of cap 44 to sidewalls of gate partition 44. Further, cap 44 is structured in a configuration such that the distal end of gate partition 42 remains entirely covered and sidewalls of the gate partition remain partially covered. However, a top sidewalls and bottom sidewall of the gate partition 42 remains exposed. Cap 44 further includes a defined outer shape 46 which corresponds to engage with inner shape 28 of end beam structure 22. The outer shape 46 of cap 44 may be properly observed in FIG. 5 of the provided drawings. It can be observed, cap 44 having a straight portion 46A and substantially curved sides 46B extending from sides of the straight portion 46A. In the present embodiment, outer shape 46 engages with inner shape 28 of end beam structure 22 to be mounted thereon. The outer shape 46 of cap 44 locks within slot portion 26 due to its defined structure. As a result, a secure mounting connection is made when inserting gate partition 42 within end beam 22. Slot portion 26 then acts as a rail that allows the gate partition to be slidably inserted therein.

Spacer assembly 60 includes a spacer member 62 configured to be inserted within slot portion 26 of end beam structure 22. In the present embodiment space member 62 is inserted to create a space between gate partitions 42 that are mounted to the end beam structure 22. In the present mounting configuration, a first gate partition is inserted into slot portion 26 of end beam 22. A spacer member 62 then follows and is slidable inserted into slot portion 26. A second gate partition is then inserted following the spacer member 62 thereby creating a spacing between the first gate partition and the second gate partition. The spacer member is provided in a shape that corresponds to the shape of slot portion 26. In one embodiment, the structure of spacer member 62 is identical to that of cap 44 of gate partition assembly 40. Additionally, spacer member 62 is provided in a configuration such that it becomes flush with sidewalls of end beam structure 22 when inserted within slot portion 26. Further, spacer member 62 is provided as having a predetermined height. The height of the spacer member depends entirely on user building a fencing structure and their desired spacing between the gate partitions 42. Some embodiments may feature a spacer member 62 with a significant height allowing humans and animals to be able to pass through the spacing created for the gate partitions. Other embodiments may feature spacer members 62 with significantly small heights to prevent individuals and animals from passing through the spacing created from the gate partitions. In another embodiment, spacer member 62 may be entirely omitted from end beam structure 22 to provide abutting and adjacently positioned gate partitions.

Figure 8:
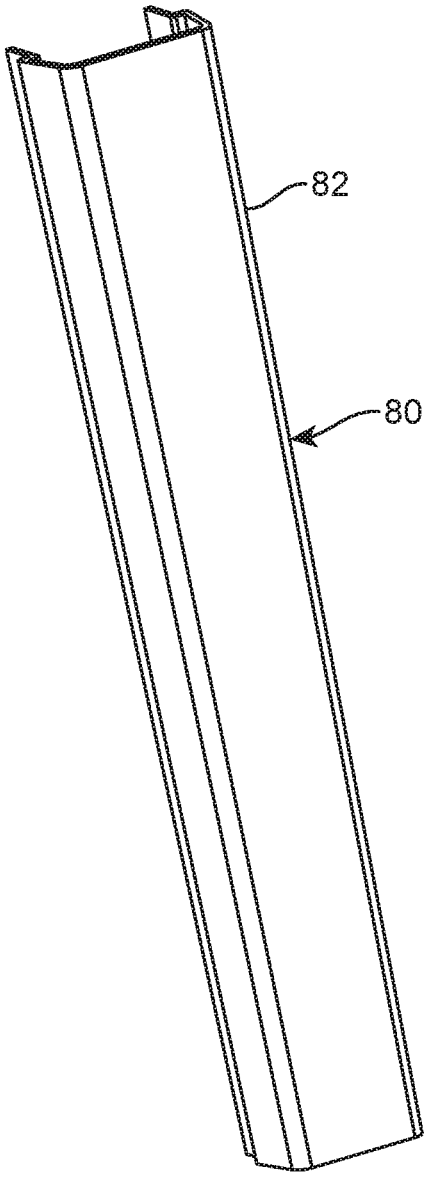
FIG. 8 represents an isometric view of cover assembly 80 in accordance to an embodiment of the present invention.
Figure 9:
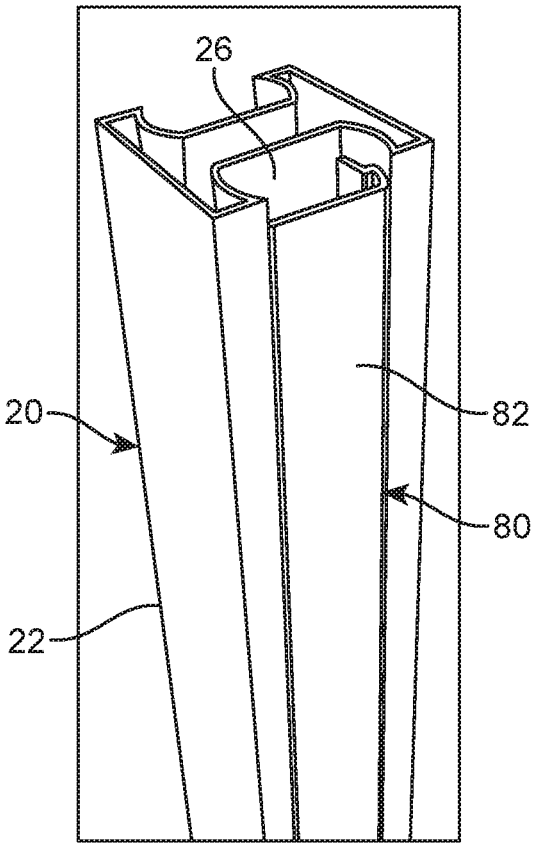
FIG. 9 shows an isometric view of cover 82 mounted within slot portion 26 in accordance to an embodiment of the present invention.
Figure 10:
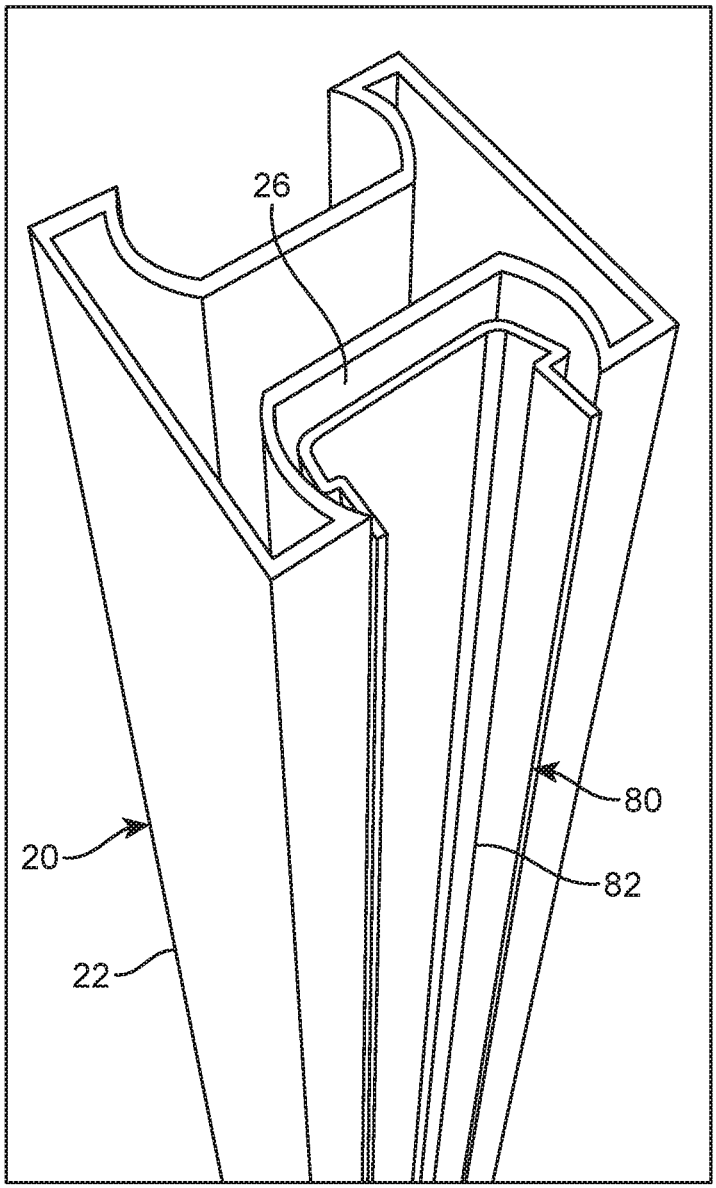
FIG. 10 illustrates an isometric view of cover 82 mounted within slot portion 26 in an inverted configuration in accordance to another embodiment of the present invention.
Figure 11:
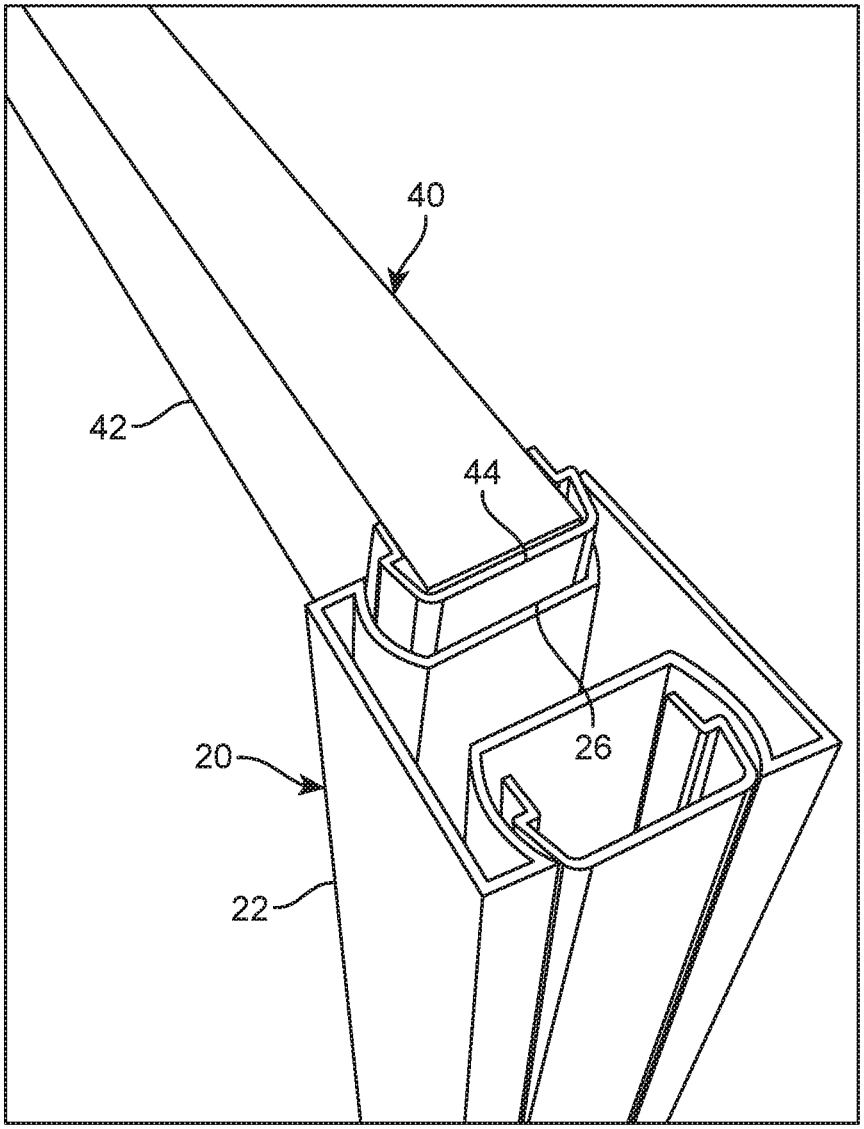
FIG. 11 is a representation of an isometric view of gate partition assembly 40 being inserted within end beam assembly 20 in accordance to an embodiment of the present invention.

Cover assembly 80 includes a cover member 82 having a first end and a second end. The cover member 82 may be properly observed in FIG. 8 of the provided drawings. In one embodiment, cover member 82 is provided as having the same structural configuration as spacer member 62. However, cover member 82 features an elongated configuration having a greater height than spacer member 62. In one implementation, cover member 82 is provided having a height which corresponds to a length of slot portion 26. That is, cover member 82 extends the entire height of end beam structure 22. Cover member 82 is slidably inserted into slot portion 26 such that an outer sidewall of cover member 82 remains flush with the sidewall of end beam structure 22. This described structure is defined as a covered configuration and can be observed in FIG. 9 of the provided drawings. The covered configuration allows end beam structure 22 to be protected from foreign debris that may invade slot portion 26 when placed in an outdoor environment. Additionally, the covered configuration provides an assembled aesthetic view to the fencing structure when assembled. Further, cover member 82 may also be inverted when being inserted within slot portion 26. When inserted, the outer sidewall of cover member not abuttingly engages straight edge portion 28A therein. This described structure is defined as an inverted configuration and can be observed in FIG. 10 of the provided drawings. This configuration provides an alternative covering structure for slot portion 26. In the inverted configuration an internal portion of cover member 82 is exposed and the no longer flush with the sidewall of end beam structure 22.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A mounting system for fencing slabs, comprising:

a) an end beam assembly including at least one end beam structure, said at least one end beam structure including at least one slot portion extending within an interior of the at least one end beam structure, said slot portion having a concave shape extending an entire height of the at least one end beam structure;

b) a gate partition assembly including at least one gate partition, said at least one gate partition having connector caps mounted on opposing distal ends which wrap around distal ends of said at least one gate partition, said at least one gate partition slidably inserted within said slot portion, wherein said slot portion acts as a rail to slidably receive said at least one gate partition, wherein said connector caps have a defined outer shape conforming to said concave shape; and c) a spacer assembly including at least one spacer member slidably inserted within said slot portion.

2. The mounting system for fencing slabs of claim 1 wherein said at least one end beam structure is a uniform solid structure.

3. The mounting system for fencing slabs of claim 1 wherein said at least one end beam structure is a hollow structure.

4. The mounting system for fencing slabs of claim 1 wherein two slot portions are provided located on opposing sidewalls of said at least one end beam structure.

5. The mounting system for fencing slabs of claim 1 wherein said end beam assembly further includes a base mounted to a bottom distal end, said at least one end beam structure being partially recessed within said base.

6. The mounting system for fencing slabs of claim 5 wherein said base is placed on a ground surface and secured through screws.

7. The mounting system for fencing slabs of claim 1 wherein said end beam structure includes two slot portions separated by a longitudinal channel within said end beam structure, said end beam structure further including two parallel latitudinal channels each being perpendicularly connected to opposing ends of said longitudinal channel.

8. The mounting system for fencing slabs of claim 1 wherein said defined outer shape includes a straight portion and substantially curved portions.

9. The mounting system for fencing slabs of claim 1 wherein said at least one spacer member has a shape which conforms to said slot portion.

10. The mounting system for fencing slabs of claim 1 wherein said at least one spacer member has a shape identical to said connector caps of said at least one gate partition.

11. The mounting system for fencing slabs of claim 1 wherein said at least one spacer member is flush with a sidewall of said at least one end beam structure when inserted within said slot portion.

12. The mounting system for fencing slabs of claim 1 further including a cover assembly having at least one cover member.

13. The mounting system for fencing slabs of claim 12 wherein said at least one cover member is slidably inserted from a top end of said slot portion.

14. The mounting system for fencing slabs of claim 13 wherein said at least one cover member extends a height identical to a height of said slot portion.

15. The mounting system for fencing slabs of claim 14 wherein said at least one cover member includes a covered configuration, wherein said at least one cover member is flush with a sidewall of said at least one end beam structure when slidably inserted within said end beam structure.

16. The mounting system for fencing slabs of claim 14 wherein said at least one cover member includes an inverted configuration, wherein an outer surface of said at least one cover member abuttingly engages with an inner wall of said concave shape of said slot portion when slidably inserted within said end beam structure, wherein a bottom of said connector cap cooperates with a shape of said concave shape.

17. The mounting system for fencing slabs of claim 1 wherein said connector caps entirely cover said opposing distal ends of said at least one gate partition.

18. The mounting system for fencing slabs of claim 1 wherein said connector caps partially extend along sidewalls of said at least one gate partition.

19. The mounting system for fencing slabs of claim 1 wherein said gate partition assembly includes at least one fastener to couple said connector caps to said at least one gate partition.

20. A mounting system for fencing slabs, comprising:

a) an end beam assembly including at least two end beam structures vertically extending from a ground surface, said at least two end beam structures being partially inserted into a base on a bottom end, wherein said at least two end beam structures includes slot portions located on opposing sidewalls, wherein said slot portions extend into an interior of the end beam structures, said slot portions having defined inner shape including a straight portion and substantially curved portions;

b) a gate partition assembly including gate partitions slidably inserted within said slot portions of said at least two end beam structures, said gate partitions having opposing distal ends with a cap mounted thereon, wherein said cap entirely covers said distal ends and partially extends along sidewalls of said gate partitions, said cap having a defined outer shape including a straight portion and substantially curved portion, said straight portion of said cap being in abutting engagement with said straight portion of said slot portions;

c) a spacer assembly including spacer members slidably inserted within said slot portions, wherein said spacer members separate said gate partitions when inserted within said slot portions; and d) a cover assembly including at least one cover member slidably inserted within said slot portions, wherein said at least one cover member extends an entire height of said slot portions.

* * * * *